US005908082A

United States Patent [19]

Turner et al.

[11] Patent Number: 5,908,082

[45] Date of Patent: Jun. 1, 1999

[54] FIRE ESCAPE LADDER

[76] Inventors: Wallace J. Turner; Alray Turner, both of 2138 Euclid Ave., Boise, Id. 83706

[21] Appl. No.: 09/087,544

[22] Filed: May 29, 1998

[51] Int. Cl.[6] ..... E06C 5/34

[52] U.S. Cl. ..... 182/18; 182/90

[58] Field of Search ..... 182/18, 90, 19; 119/484

[56] References Cited

U.S. PATENT DOCUMENTS

| | | | |
|---|---|---|---|
| 381,656 | 4/1888 | Thompson | 182/90 |
| 2,756,323 | 7/1956 | Tusly | 240/2 |
| 4,074,225 | 2/1978 | Vandeweghe | 340/237 R |
| 4,148,023 | 4/1979 | Elkin | 340/628 |
| 4,311,208 | 1/1982 | Macrorie et al. | 182/18 |
| 4,347,499 | 8/1982 | Burkman, Sr. et al | 340/371 |
| 4,401,050 | 8/1983 | Britt et al. | 116/205 |
| 4,531,114 | 7/1985 | Topol et al. | 340/539 |
| 4,709,782 | 12/1987 | Lipinski | 182/3 |
| 4,801,928 | 1/1989 | Minter | 340/691 |
| 5,018,600 | 5/1991 | Sobczak | 182/70 |
| 5,651,331 | 7/1997 | Cleri, Jr. | 119/484 |

*Primary Examiner*—Daniel P. Stodola
*Assistant Examiner*—Hugh B. Thompson
*Attorney, Agent, or Firm*—Robert L. Shaver; Frank J. Dykas

[57] ABSTRACT

A fire escape ladder which includes recessed steps which are mounted into an interior or exterior wall of a house, or the concrete walls of a basement, to provide an escape route to a window. When the ladder is used, the lock to the window is automatically released, and springs in the window frame cause the window to partially open. An associated smoke detector or a connection to the household smoke detector activates lights in the recessed steps and an audible alarm which aids in egress from a dark or smoke-filled building.

15 Claims, 7 Drawing Sheets

FIRE ESCAPE LADDER

BACKGROUND OF THE INVENTION

1. Field of the Invention

The present invention generally relates to fire escape ladders, and more particularly to fire escape ladders which use steps recessed into the wall of a building.

2. Background Information

In case of a fire in a building, the occupants of a building need to be able to escape, often through the windows of the building. This can be problematical, because windows may be hard to climb out of, and they may be hard to unlock and to open. These problems are especially difficult for the infirm and for children. A blind person may also become disoriented in the confusion of a fire and not be able to find the window. The task of escaping from a room through a window is made more difficult in older homes. Older homes often have windows which are 48 or 54 inches from the floor. This is much higher, and harder to get out of for children, than more recent homes, which are required by most building codes to have windows no more than 33 inches from the floor. These lower windows are called easy egress windows, because they facilitate a child escaping through the window. The older style of windows can be modified to make their lower edge lower to the floor, but modification is expensive and requires dismantling a section of wall. There is a need for a simple modification to these older and higher windows to make it easier to escape from them in a fire.

Many prior art devices solve the fire escape problem by providing various types of ladder systems to allow the occupants of a building to escape. A ladder may be contained in a collapsed position and extend out from a window when it is deployed. Other ladders can be of rope with rungs, and be deployed from a storage box at the window. Alarm and lighting systems in buildings can flash and sound an alarm to alert the occupants to fire danger somewhere in the building, and can even direct them to the best route for escape, either by a standard pre-programmed escape route, or by sensing the location of the fire by the use of fire sensors and directing the person to a safe exit. However, these systems might not be of very much use in a residential setting, in which a blind person, disabled person or a child must escape from a room by climbing out the window. In that situation, a child, a blind person or an infirm person might have a hard time finding the window in the dark or the dense smoke, and they might have a hard time opening the window, and they may have a hard time deploying a ladder and climbing out the window. Once even in the window, they might have a hard time climbing down the outside wall of the house if the room were on an upper floor.

Accordingly, it is an object of the invention to provide a fire escape ladder which uses steps recessed in a wall and is thus always available for use. It is another object of this invention to use a fire escape ladder which does not require deployment by the user. An object of the fire escape ladder is to be suitable for use by children, the elderly, disabled and blind.

A further object of the invention is to provide a way to modify high windows inexpensively to make them easy to escape from.

It is a further object of the invention to provide a fire escape ladder which has included in it a locator light, so that the ladder can be found through the smoke of a fire and in the darkness of night.

It is a further object of the invention to provide a fire escape ladder which has an audible alarm to alert the user of a fire and to guide the user to the ladder.

It is a further object of the invention to provide a fire escape ladder for escape from a basement by climbing up the basement wall, using recessed steps.

It is a further object of this invention to provide a fire escape ladder for escape down an outside wall of a house.

It is a further object of this invention to provide a fire escape ladder which opens or unlocks a window when used.

Additional objects, advantages and novel features of the invention will be set forth in part in the description as follows, and in part will become apparent to those skilled in the art upon examination of the following, or may be learned by practice of the invention. The objects and advantages of the invention may be realized and attained by means of the instrumentalities and combinations particularly pointed out in the appended claims.

SUMMARY OF INVENTION

The foregoing and other objects and advantages are attained in the present invention by a fire escape ladder which utilizes steps recessed into a wall. The recessed steps are used as handholds and footholds and allow a person to climb up a wall to a window, up a basement wall when set in concrete to a basement window, and down an outside wall when placed in an outside wall. The fire escape ladder further includes a linkage from one or more of the recessed steps to a window lock. When a person steps on the recessed step, the connecting linkage unlocks the window, allowing the person to escape through the window. The linkage can further activate a window opening mechanism, such as a spring. In this combination, stepping on the recessed step would not only unlock the window, but would cause it to spring open at least a few inches. This would enable a person to find the edge of the open window, even in the dark, in thick smoke, or if the person were blind, and further open the window and escape. The escape ladder can include a light mounted in one or more of the recessed steps. The light would typically be linked to a house fire alarm and would be activated when the house fire alarm or the escape ladder fire alarm is activated. The escape ladder can have its own fire alarm, which is independent from that of the house fire alarm, and may have a backup battery so it and the light and audible alarm would continue to work in a power outage. The advantage of a fire alarm in the escape ladder would be that the fire escape ladder fire alarm would be set at a different height than that of the house fire alarm, and when the smoke reached a lower level, it would be activated and turn on the light and an audible alarm. The audible alarm could be a gong or buzzer sound, or it could also be a recorded voice. The recorded voice could be that of a child's parents, and encourage the child to come towards the recorded voice, climb up the ladder and escape from the room out the window. The fire escape ladder could also be formed of recessed steps which are imbedded in a concrete wall as it is being poured, such as in a basement wall. These recessed steps would enable a person to climb up the concrete wall to reach a basement window for escape from a fire. The recessed step could also be mounted on a structural member of the house wall, such as a wall stud, and would include a supporting brace and a generally rectangular step pocket. The step pocket would have a ridge on its lower front edge to provide a grip for a handhold or a foothold.

The linkage which connects a recessed step to a window lock would include a foot pedal mounted in the recessed step and hinged on one edge, which is activated by a user stepping on the foot pedal. Attached to the foot pedal would be a linkage, such as a rod, a chain, a cable, or any other positive linkage, which is connected to a window lock. When the foot pedal is stepped on, it is pushed down by the weight of the user. The linkage connected to the foot pedal is also pulled down and this causes a lock on the window to be released. The window can be fitted with a spring-loaded device which causes the window to spring open at least a few inches as soon as the window lock is released. This would allow a child or another person escaping the fire, especially a blind person, to find the open window and fully open it in darkness, or in heavy smoke.

Still other objects and advantages of the present invention will become readily apparent to those skilled in this art from the following detailed description wherein I have shown and described only the preferred embodiment of the invention, simply by way of illustration of the best mode contemplated by carrying out my invention. As will be realized, the invention is capable of modification in various obvious respects all without departing from the invention. Accordingly, the drawing and description are to be regarded as illustrative in nature, and not as restrictive.

DESCRIPTION OF THE PREFERRED EMBODIMENTS

Figure 1:
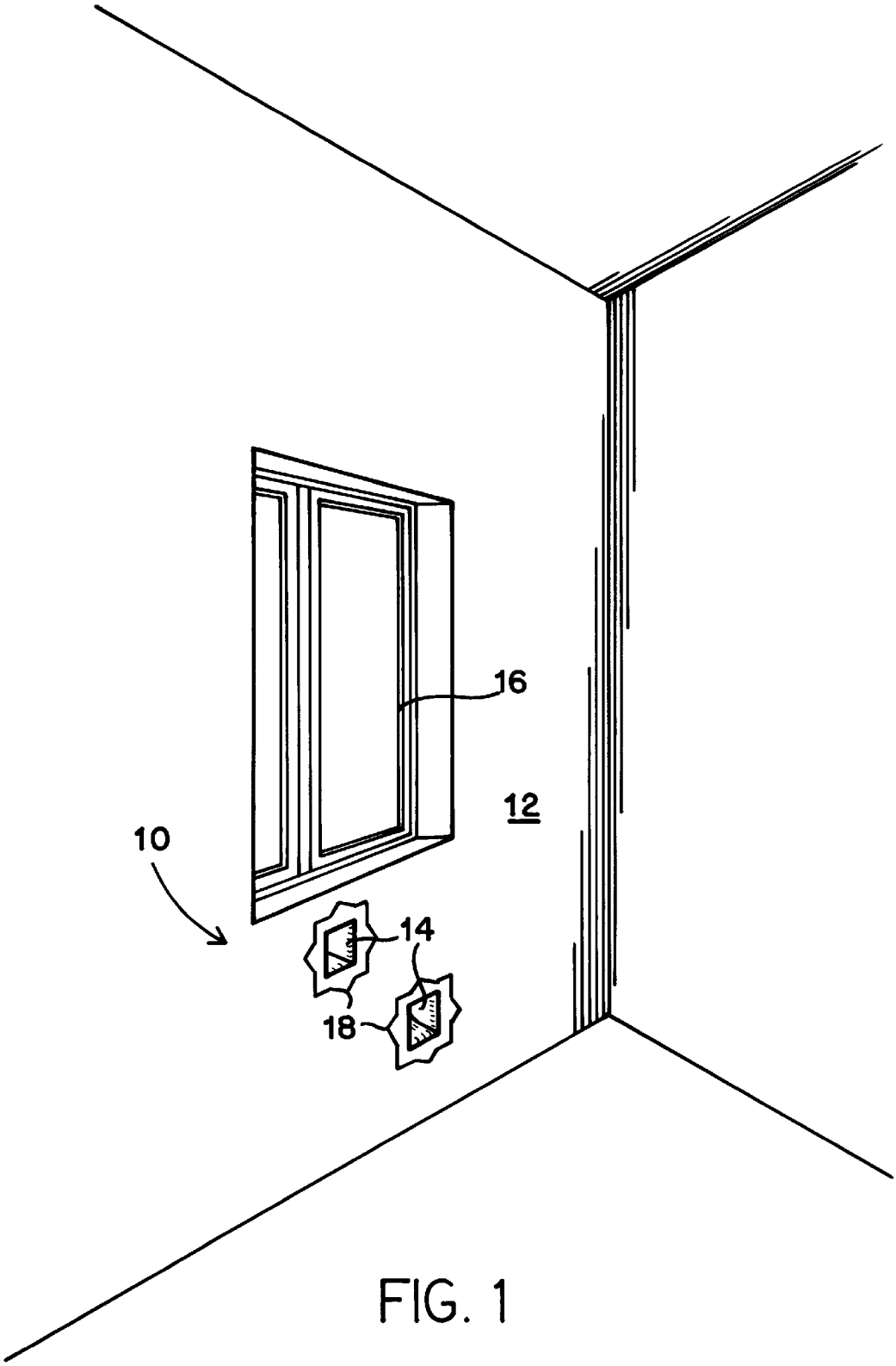
FIG. 1 is a perspective view of a fire escape ladder installed below a window.

The preferred embodiments of the invention are shown in FIGS. 1 through 7. FIG. 1 is a perspective view of the fire escape ladder 10 installed on an interior wall 12 of a house. The fire escape ladder 10 includes one or more recessed steps 14 mounted below a window 16. As shown in FIG. 1, each of the recessed steps 14 can be mounted with a decorative plate 18, which can be shaped appropriately for the user. For instance, in a child's room, the decorative plates 18 might be shaped like animals or popular action figures, while in an adult's room they might be shaped and colored to complement the decor of the room.

Figure 2:
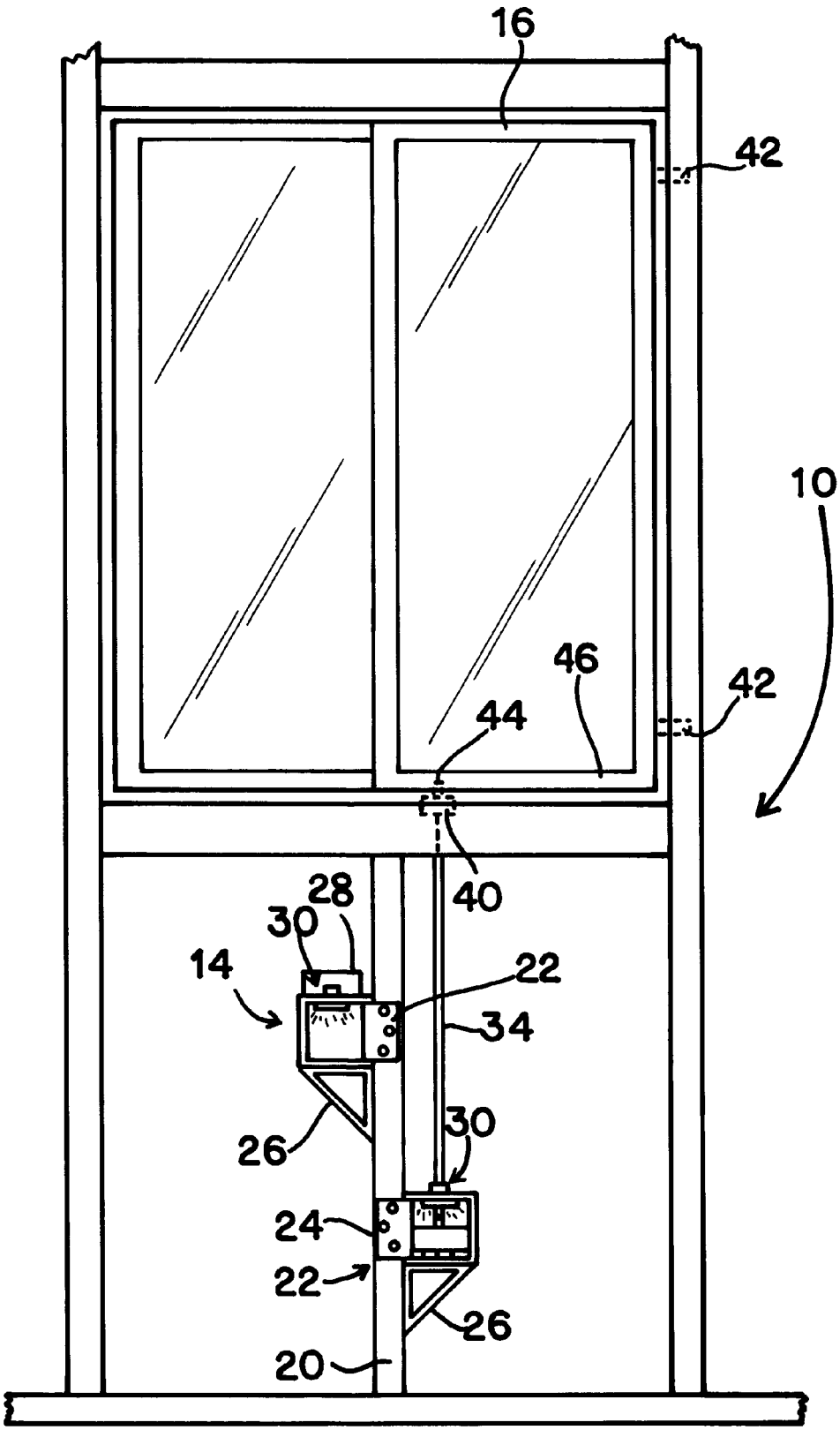
FIG. 2 is a front view of a fire escape ladder installed on the studs of a wall beneath a window.

FIG. 2 also shows a window 16 with a window lock 40 and window springs 42.

FIG. 2 is a front view of the fire escape ladder 10 showing its attachment to a structural member 20 of a wall. The recessed step 14 is a generally rectangular box with one side open for insertion of the user's foot or hand. The recessed step 14 can be made of metal or plastic. An attachment plate 22 is included for attaching the recessed step 14 to the structural member, or stud 20. The attachment plate 22 includes nail holes 24. A flange can extend to the outside of the sheet rock of the wall, to protect the edge of the sheet rock when a person steps on it. A reinforcing bracket 26 would typically be mounted below each recessed step 14. The reinforcing bracket 26 is preferably made of sheet metal, although many other materials would work equally well, such as a triangle or block of wood or plastic. The preferred reinforcing bracket 26 is a three-sided shape which appears triangular from an end view. One edge of the reinforcing bracket 26 is attached to the stud 20. Another edge is placed under the recessed step 14, and can be attached to the recessed step 14, and a third edge joins the first and second edge, and forms a reinforcing leg. Included with the fire escape ladder 10 can be a smoke alarm 28. The smoke alarm 28 can be wired to the household smoke alarm, or it can act independently. If it acts independently, a useful feature of this smoke alarm 28 would be that it senses smoke at a different height than the household smoke alarm. It would activate when smoke reached a lower level in the room, and when escape from the room became imperative. If wired to the house electrical system, it would preferably include a backup battery so that it would continue to operate in a power outage.

The fire escape ladder 10 can also include a light 30 in at least one and preferably in each of the recessed steps 14. The light 30 in each recessed step 14 is preferably hard wired to the electrical system of the house, and also connected to the backup battery. It would also be connected to smoke alarm 28, and when the smoke alarm 28 was activated, the lights 30 would also be activated. With the smoke alarm 28, an audible alarm (not shown) would also be activated. The audible alarm could use any number of different tones, including a buzzer, a gong-like tone, a beeping tone, a siren sound, or it could also utilize a recorded human voice. The recorded human voice could be a person giving pre-recorded instructions, or it could be customized by the user, so that the pre-recorded voice was the sound of a child's parent giving them instructions to come toward the sound of the voice, climb up the lighted steps, open the window, and escape from the house.

Figure 3:
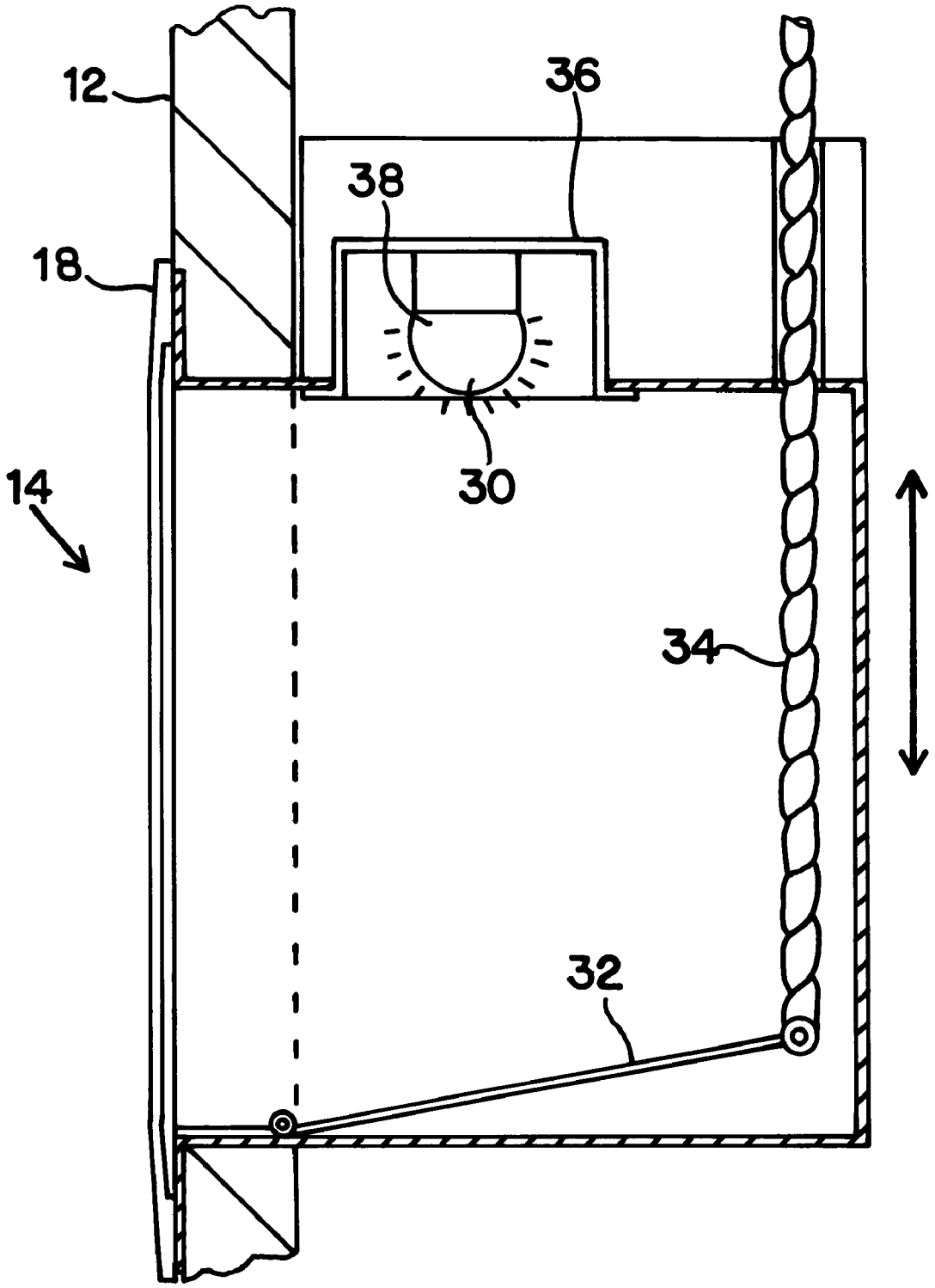
FIG. 3 is a cross-sectional side view of a recessed step showing the light and linkage.

FIG. 3 shows a cross-sectional view of one of the recessed steps 14. In the recessed step 14, a hinged pedal 32 is shown, connected to a linkage rod 34. A light 30 is shown in a light compartment 36. The light 30 is mounted in the light compartment 36, so that a bulb 38 can be replaced, and so that none of the components of the lighting system extend into the step 14 and would result in a user striking it with a foot or hand.

In use, the fire escape ladder 10 would be installed by mounting the recessed steps 14 on a stud 20. A window lock 40, which is compatible with fire escape ladder 10, would be mounted on the underside of the window 16. Also attached to the window 16 are spring devices 42. When the window 16 is closed, the spring devices 42 are compressed and the window lock 40 is pressed into an opening in the bottom of the window frame 46. The smoke detector lights and audible alarm of the fire escape ladder 10 are connected to the household circuit for electricity, and include a back-up battery.

When a user climbed up the fire escape ladder 10, his weight would press down on the pedal 32 and pull the linkage rod 34 down. This would withdraw the locking pin 44 from the window frame 46. With the locking pin 44 withdrawn from the window frame 46, the window frame 46 would be pressed away from its closed position by the window springs 42. This would result in the window 16 being open at least a few inches. This would allow the user to feel the draft of air from the window 16, if the user were blind, in darkness, or in heavy smoke. The user could then put a hand through the window 16 and open window 16 the rest of the way. He could then escape out the window to safety outside.

Figure 4:
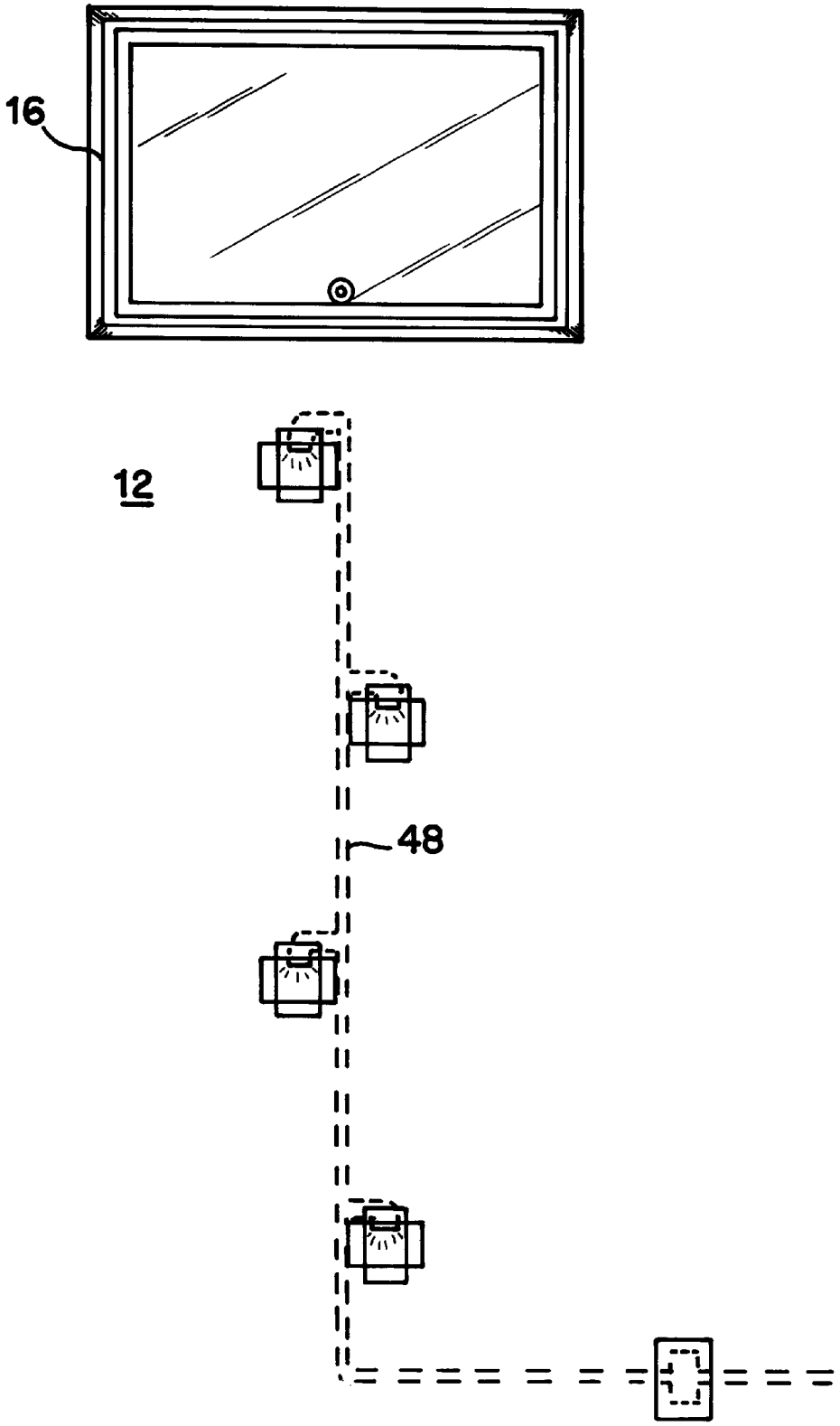
FIG. 4 is a front view of a fire escape ladder installed in the concrete of a basement.

Another embodiment of the invention is shown in FIG. 4. In this figure, the window 16 is a basement window, and the interior wall 12 is the poured concrete wall of a basement. The recessed steps 14 are mounted before the concrete is poured, including their electrical wiring 48. When the concrete is poured around the recessed steps, they form handholds and footholds for climbing up the vertical concrete wall of a basement. The smoke alarm 28, light 30, and audible alarm would work the same as the previous embodiment. This version of the device, like the first version, could be utilized without a linkage rod 34 connecting to the window lock 40 on the window 16. However, the preferred embodiment would include a linkage rod 34 connected to one or more of the recessed steps 14 with a hinged pedal 32. When a person put weight on one of the hinged pedals 32, the basement window 16 would be unlocked and spring partially open.

Figure 5:
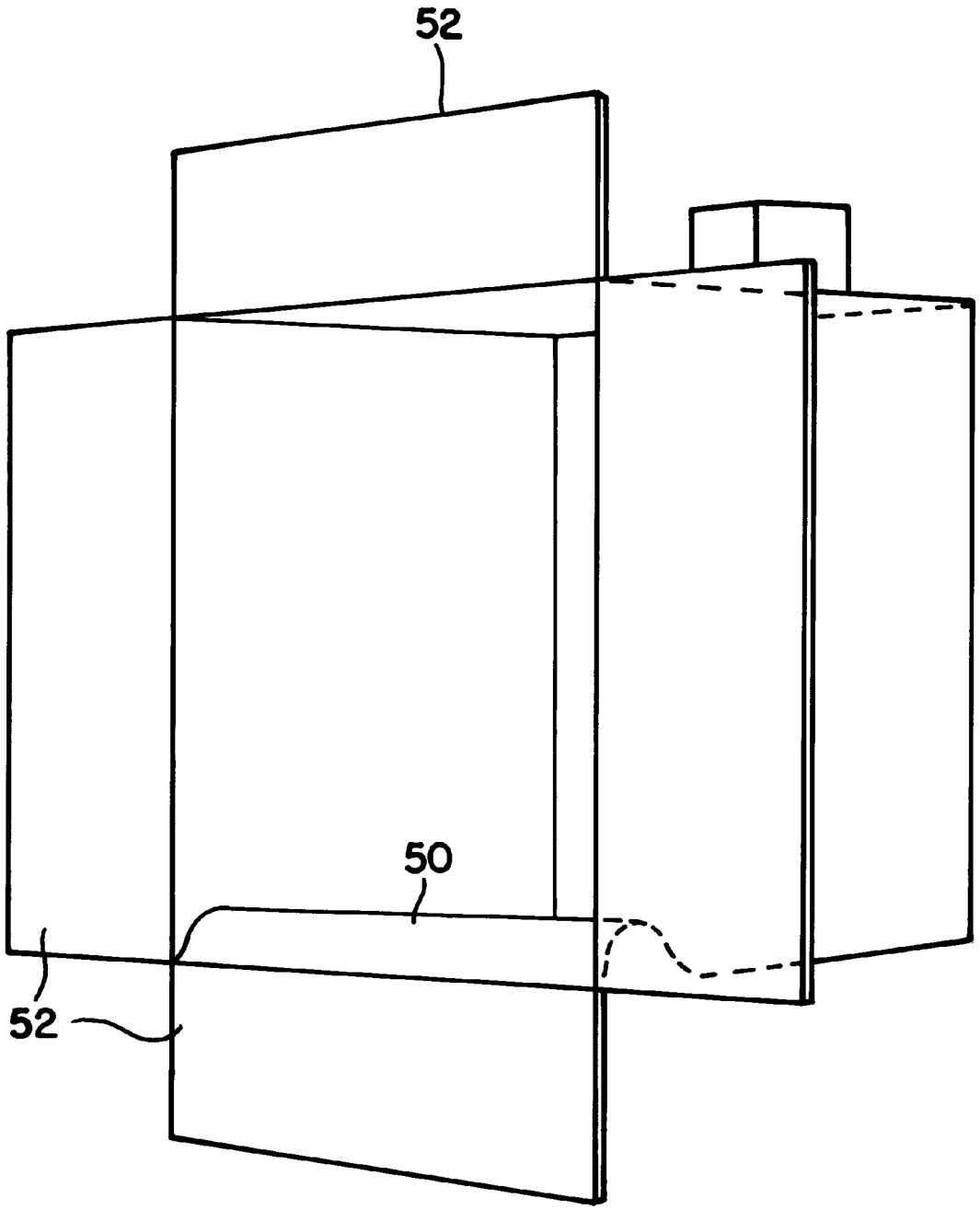
FIG. 5 is a perspective view of a recessed step showing a handhold ridge.

FIG. 5 is a perspective view of a recessed step 14 which could be used with concrete forms (not shown). Included in this version of the recessed step 14 is an optional gripping ridge 50. Also included are flanges 52. These flanges 52 could be nailed to the forms into which the concrete of the wall is poured, and they could have structures which are gripped by the concrete when it dries, and holds the recessed step 14 in place within the concrete.

Figure 6:
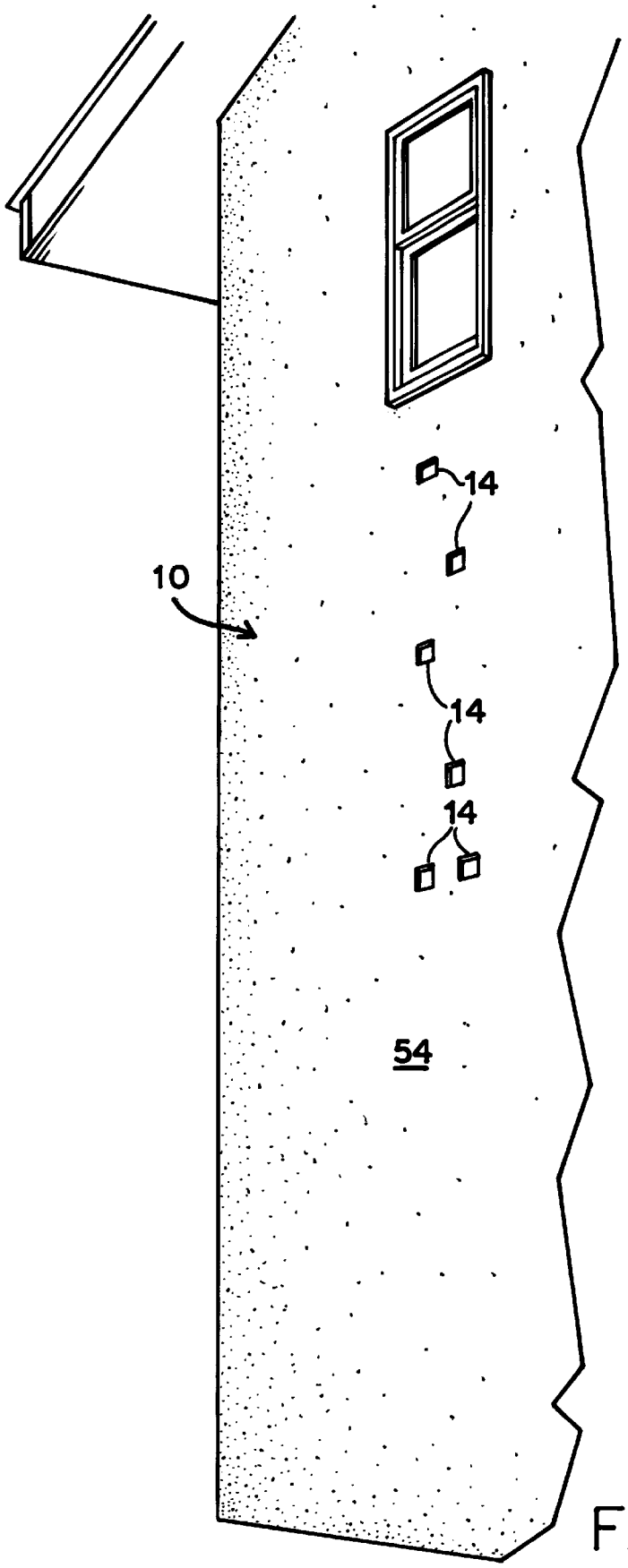
FIG. 6 is a perspective view of a fire escape ladder installed on the outside of a house.
Figure 7:
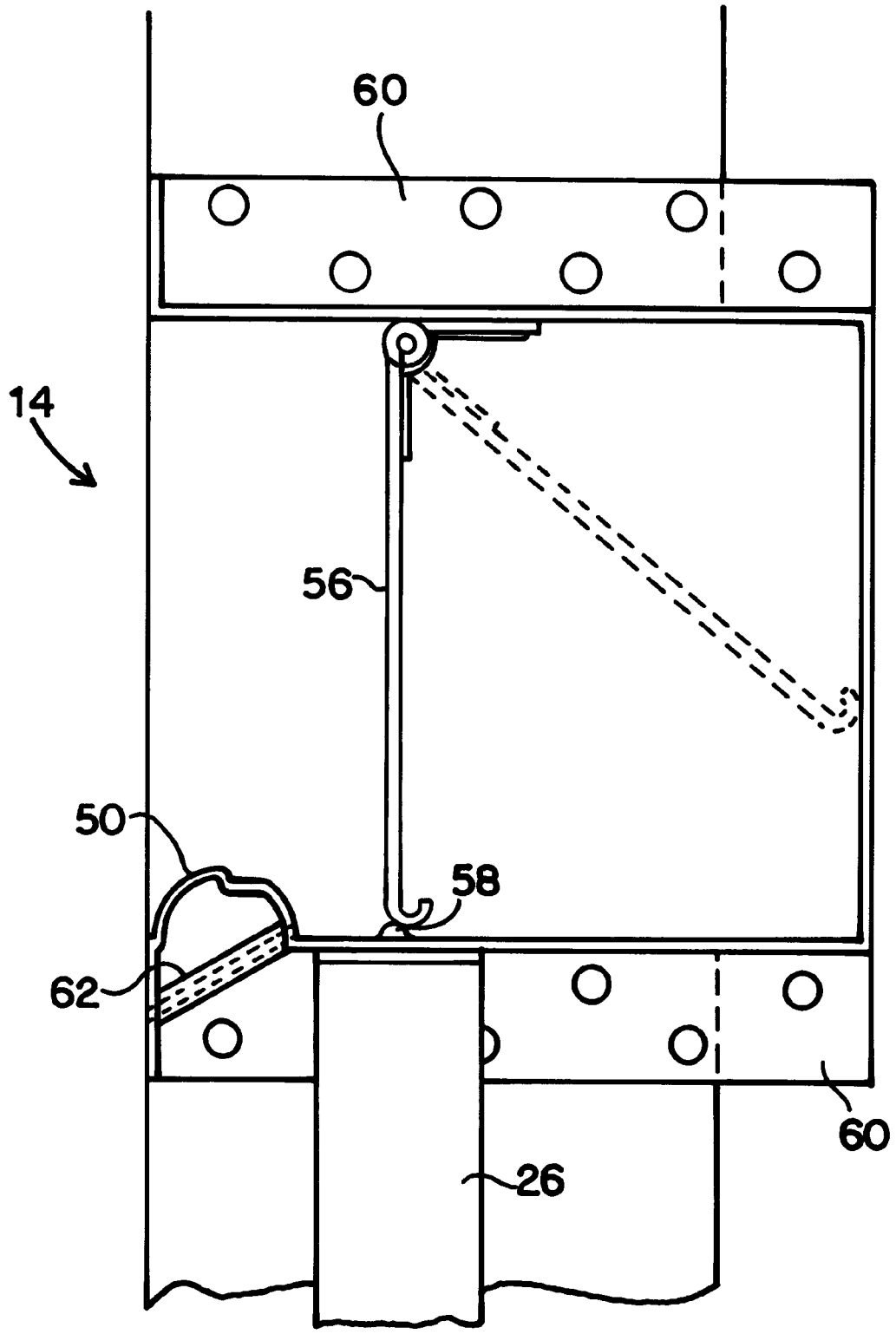
FIG. 7 is a side cross-sectional view of a fire escape ladder with a recessed step for mounting on the outside of a house.

FIG. 6 shows an outside wall 54 of a house with recessed steps 14 of a fire escape ladder 10 mounted on the outside wall 54. Recessed steps 14 thus mounted serve as an escape ladder down the wall of a building in time of emergency exit. The recessed steps 14 can terminate above the first story, as shown in FIG. 6. This arrangement makes it harder for the recessed steps 14 to be used as an entry way to the window 16. Alternatively, the recessed steps 14 can extend in a ladder-like arrangement all the way to the ground. The recessed steps mounted on the outside wall of a house can be fitted with an alarm which sounds when the steps are used when no fire is detected, or when used from the ground to climb up to the window. When recessed steps 14 are mounted on the outside of a house, they can be fitted with a covering which helps to blend the appearance of the recessed steps 14 into the appearance of the outside wall. They can also have a hinged door 56 which is weatherproof, and keeps water, snow, dust and leaves and other environmental debris from collecting inside the recessed steps 14. A cross-sectional view of one possible configuration of such an outside step is shown in FIG. 7. This view includes a drain hole 62, through which trapped water can drain from the step.

FIG. 7 shows a hinged door 56 which interconnects with a water stopping threshold 58. Also provided is a gripping ridge 50 which provides a better hand grip or foot grip for the user. An optional mounting flange 60 is shown, with a reinforcing bracket 26.

While there is shown and described the present preferred embodiment of the invention, it is to be distinctly understood that this invention is not limited thereto but may be variously embodied to practice within the scope of the following claims.

We claim:

1. A fire escape ladder for installation in a wall of a building having an opening, comprising:

at least one recessed step with five sides which define a cavity, for mounting in said wall, for use as handholds and footholds by insertion of a hand or foot into said cavity of said at least one recessed step when climbing said wall to escape a fire through a window;

a linkage assembly from said at least one recessed step to a retractable window locking pin adapted to interfit with a window which comprises said opening in said wall, in which said linkage assembly retracts said window locking pin when said at least one recessed step is stepped in by a user, for assisting said user to open said window for escape.

2. The fire escape ladder of claim 1 which further comprises a light in one or more of said recessed steps, linked to a house fire alarm wherein said light is activated when said house fire alarm is activated.

3. The fire escape ladder of claim 1 which further comprises an audible alarm attached to said at least one recessed step and linked to a house fire alarm wherein said audible alarm is activated when said house fire alarm is activated.

4. The fire escape ladder of claim 3 in which said audible alarm is a recorded human voice.

5. The fire escape ladder of claim 1 in which said at least one recessed step is configured for embedding in a poured concrete wall, to enable a person to climb up or down said concrete wall to reach a window for escape.

6. The fire escape ladder of claim 1 in which said at least one recessed step is mounted to a structural member and comprises five walls which define a cavity, in which a lower wall serves as a step or handhold, and includes a supporting brace.

7. The fire escape ladder of claim 1 which further comprises a gripping ridge on a lip of said at least one recessed step, which is for gripping by a user and which provides a more secure handhold and foothold for a hand or foot which is inserted in said at least one recessed step.

8. The fire escape ladder of claim 1 in which said at least one recessed step is configured for mounting on an exterior side of a building and which have a hinged door for excluding environmental debris from said at least one recessed step.

9. The fire escape ladder of claim 1 in which said linkage assembly comprises:

a foot pedal in said at least one recessed step, which is activated by a user stepping on said foot pedal;

a linkage, which connects to said food pedal and to said retractable window locking pin;

said retractable window locking pin being retracted when activated by said linkage.

10. The fire escape ladder of claim 1 in which said opening in a building wall further comprises a spring mechanism adapted for mounting in a window frame, which is adapted to push said window partially open when said linkage is activated by a user.

11. A fire escape ladder for installation in a wall of a building having an opening, comprising at least one recessed step for mounting in a wall, for use as handholds and footholds when climbing said wall to escape a fire through a window which comprises said opening in said wall;

a linkage assembly from said at least one recessed step to a retractable window locking pin, wherein a person stepping on said at least one recessed step activates said linkage assembly which retracts said window locking pin, allowing the person to open a window for escape;

a spring mechanism adapted to fit in a window frame which is activated by said linkage assembly, and which is adapted to push said window partially open when said retractable window locking pin is retracted;

one or more lights in one or more of said at least one recessed step, linked to a fire alarm wherein said light is activated when said fire alarm is activated; and an audible alarm mounted on said at least one recessed step, and linked to a fire alarm wherein said audible alarm is activated when said fire alarm is activated.

12. A fire escape ladder for installation in a wall of a building having an opening, comprising;

at least one recessed step for mounting in a wall, for use as handholds and footholds when climbing said wall to escape a fire through a window which comprises said opening in said wall; and a linkage assembly from said at least one recessed step to a retractable window locking pin, wherein a person stepping on said at least one recessed step activates said linkage assembly which retracts said window locking pin, allowing the person to open said window and escape.

13. The fire escape ladder of claim 12 in which said linkage assembly comprises:

a foot pedal in said at least one recessed step, which is activated by a user stepping on said foot pedal;

a linkage, which connects to said foot pedal and to said retractable window locking pin, and;

said window locking pin being retracted when activated by said linkage.

14. The fire escape ladder of claim 12 which further comprises a spring mechanism adapted for mounting in a frame of said window, which is adapted to push said window partially open when said linkage assembly is activated by a user.

15. A fire escape ladder for installation in a wall of a building having an opening, comprising:

at least one recessed step for mounting in said wall, for use as handholds and footholds when climbing said wall to escape a fire through a window which comprises said opening in said building;

a foot pedal in said at least one recessed step, which is activated by a user stepping on said foot pedal;

a linkage assembly, which connects to said foot pedal and to a retractable window locking pin, wherein a person stepping on said at least one recessed step activates said linkage assembly which retracts said window locking pin, allowing the person to open said window for escape; and a spring mechanism which is adapted to push said window partially open when said linkage is activated by a user.

* * * * *